US007896793B2

(12) United States Patent
Pearson et al.

(10) Patent No.: US 7,896,793 B2
(45) Date of Patent: Mar. 1, 2011

(54) FOLDED BOXES AND METHODS OF MAKING THE SAME

(75) Inventors: Scott D. Pearson, Woodbury, MN (US); Carter J. Reese, Eden Prairie, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 702 days.

(21) Appl. No.: 11/556,239

(22) Filed: Nov. 3, 2006

(65) Prior Publication Data

US 2007/0108260 A1 May 17, 2007

Related U.S. Application Data

(60) Provisional application No. 60/736,221, filed on Nov. 14, 2005.

(51) Int. Cl.
*B31B 1/26* (2006.01)

(52) U.S. Cl. ..... 493/79; 493/68; 493/309

(58) Field of Classification Search ..... 493/79, 493/68, 69, 309, 310, 311
See application file for complete search history.

(56) References Cited

U.S. PATENT DOCUMENTS

| | | | | |
|---|---|---|---|---|
| 1,135,117 | A | | 4/1915 | Lafore |
| 1,985,990 | A | | 1/1935 | Hanson |
| 2,221,368 | A | | 11/1940 | Buser |
| 2,676,750 | A | | 4/1954 | Gastright |
| 2,874,891 | A | | 2/1959 | Kelsall |
| 3,009,625 | A | | 11/1961 | Ackley et al. |
| 3,204,849 | A | | 9/1965 | Vinney |
| 3,322,323 | A | | 5/1967 | Greene et al. |
| 3,512,823 | A | | 5/1970 | D'Esposito et al. |
| 3,642,192 | A | | 2/1972 | Wilcox, Jr. et al. |
| 4,179,061 | A | | 12/1979 | Gilbert |
| 4,264,255 | A | | 4/1981 | Saro et al. |
| 4,547,112 | A | | 10/1985 | Steinhart |
| 4,784,558 | A | | 11/1988 | Toriyama |
| 4,793,507 | A | | 12/1988 | Delplanque |
| 4,880,141 | A | | 11/1989 | Gossler et al. |
| 4,927,026 | A | | 5/1990 | Gossler et al. |
| 5,014,907 | A | | 5/1991 | Hollander et al. |
| 5,230,690 | A | * | 7/1993 | Adkinson et al. ..... 493/311 |
| 5,318,219 | A | * | 6/1994 | Smith ..... 229/117.05 |
| 5,934,474 | A | | 8/1999 | Renninger et al. |
| 6,080,096 | A | * | 6/2000 | Becker et al. ..... 493/311 |
| 6,637,645 | B2 | | 10/2003 | Ferguson |
| 2004/0188365 | A1 | | 9/2004 | Forte |

FOREIGN PATENT DOCUMENTS

| | | |
|---|---|---|
| CH | 655706 | 5/1986 |
| DE | 3925490 | 8/1990 |
| EP | 0 609 757 | 8/1994 |
| EP | 1 231 170 | 8/2002 |

(Continued)

OTHER PUBLICATIONS

Brochure entitled P2 Pack™ Pollution Prevention Pack, PR-108a, date unknown.

*Primary Examiner* — Sameh H. Tawfik
(74) *Attorney, Agent, or Firm* — Lisa P. Fulton; Yen Tong Florczak

(57) ABSTRACT

The folded collapsed boxes containing substantially no open gaps are provided. A plurality of different size folded collapsed boxes can be bundled together to yield a display that has the maximum number of folded collapsed boxes displayed thus conserving space.

3 Claims, 2 Drawing Sheets

FOREIGN PATENT DOCUMENTS

| | | |
|---|---|---|
| GB | 2 132 174 | 7/1984 |
| JP | 5-32253 | 2/1993 |
| JP | 5-162222 | 6/1993 |
| JP | 9-208072 | 8/1997 |
| KR | 1019980076664 | 11/1998 |
| KR | 2020000016858 | 9/2000 |

* cited by examiner

FOLDED BOXES AND METHODS OF MAKING THE SAME

CROSS REFERENCE TO RELATED APPLICATION

This application claims priority to U.S. Provisional Application 60/736221, filed Nov. 14, 2005, which is incorporated by reference in its entirety.

FIELD OF INVENTION

The present invention pertains to folded boxes. In particular, the present invention pertains to a box that is folded so as to maintain its specific volume from the initial collapsed state to its final folded state. The folded box contains substantially no open gaps.

BACKGROUND

There are many folded boxes and many methods for folding boxes disclosed in the prior art, many of which introduce open gaps into the folded box. As open gaps increase the volume of the folded box, they create inefficient use of space, especially shelf space of a display rack in a retail store.

There is a need for folding boxes more efficiently so as to maximize use of the shelf space.

SUMMARY

In one aspect, the present invention pertains to a method of folding a box. The method comprises the steps of: (1) providing a collapsed box having an initial specific volume and an initial footprint; (2) folding the collapsed box forming at least two panels, the folded collapsed box having a final specific volume and a final footprint. The panels are substantially similar in size and are disposed on top of one another. The final specific volume of the folded collapsed box is substantially similar to the initial specific volume of the collapsed box and the final footprint is smaller than the initial footprint.

In another aspect, the present invention pertains to a method of folding a box. The method comprises the steps of: (1) providing a collapsed box having a first footprint; (2) folding the collapsed box forming at least two panels, the folded collapsed box having a final footprint. The panels are substantially similar in size and are disposed on top of one another. The folded collapsed box contains no open gaps.

One advantage of the present invention is that it yields a folded box that has the smallest footprint, for a given number of folds, while not increasing the volume of the folded box from its collapsed state. In this way, the inventive folded box can be displayed efficiently on a shelf because the greatest number of folded boxes can be displayed for a given display shelf.

As used herein, a "box" is a type of container formed from a plurality of joined sidewalls; typically four sidewalls are used and the box includes cover flaps and bottom flaps. A "collapsed box" is a formed container folded on its originally formed creases so as to have the sidewalls stacked on top of one another. An "originally formed crease" is one that made by the box manufacturer to create the sidewalls of the box. A collapsed box would typically have two layers of cardboard, either corrugated or non-corrugated disposed on one another, the first layer includes two sidewalls and the second layer includes the remaining two sidewalls. A "folded box" is the collapsed box folded so that its final footprint is smaller than its initial footprint. An "in-fold" is a fold in the side of the box so as to have the sidewalls touching or nearly touching one another. An illustration of an in-fold is described in German publication DE 3925490. An "open gap" is open space between the panels of the folded box and does not include the open gaps that are in a corrugated sheet of cardboard forming the box.

BRIEF DESCRIPTION OF THE DRAWINGS

The invention can be further described with reference to the following figures, wherein.

The figures are idealized, are not drawn to scale, and are intended for illustrative purposes only.

DETAILED DESCRIPTION

Figure 1:
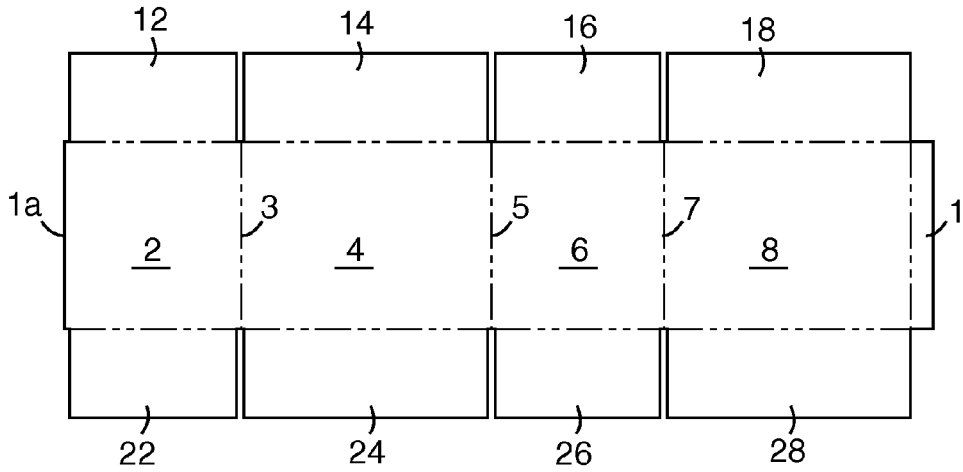
FIG. 1 is a top plan view of an unassembled corrugated or non-corrugated sheet of cardboard.

FIG. 1 is a top plan view of a sheet of corrugated or non-corrugated cardboard having sidewalls 2, 4, 6 and 8 separated by original creases denoted by phantom lines 3, 5 and 7. The sheet also includes cover flaps 12, 14, 16, and 18 and corresponding bottom flaps 22, 24, 26, and 28. The sheet of cardboard of FIG. 1 can be formed into box by attaching extension 1 to side 1*a* and folding in the cover and bottom flaps. An assembled box, as shown schematically in FIG. 2, has contiguously joined sidewalls. The assembled box has a length L, a width W, and a height H. In this particular embodiment, the box has a generally rectangular cross-section, as the length is longer than the width. Square boxes, where the length the width are the same but the height of the box can vary, as well as boxes of other geometries, are within the scope of the present invention.

Figure 2:
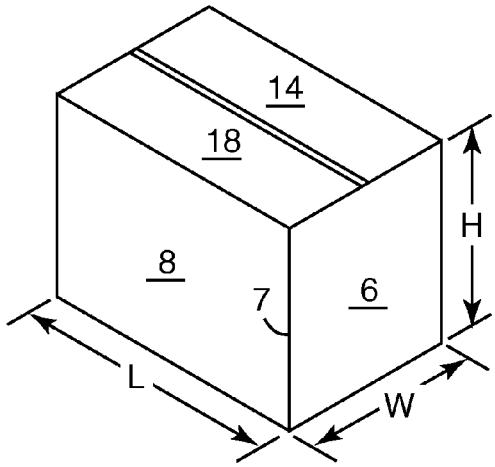
FIG. 2 is a perspective view of the sheet of cardboard of FIG. 1 assembled into a box.
Figure 3:
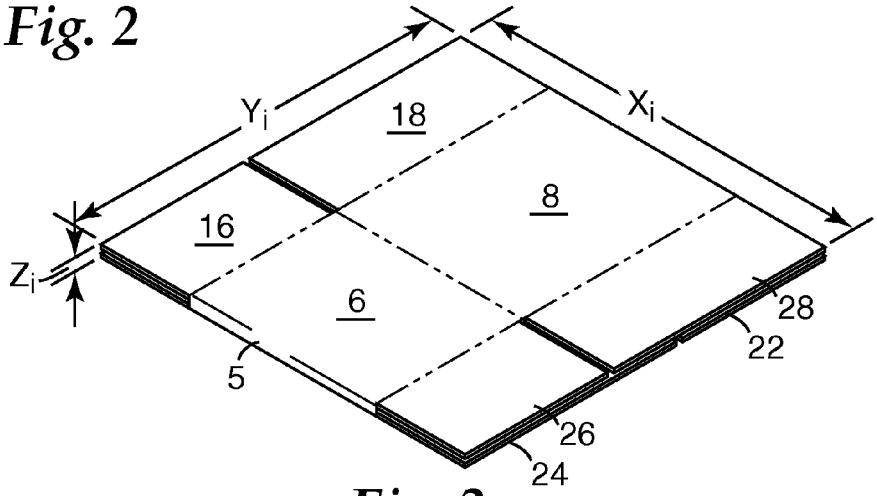
FIG. 3 is a perspective view of the assembled box of FIG. 2 in a collapsed state.

FIG. 3 is a perspective view of the assembled box of FIG. 2 in a collapsed state. The collapsed box has an initial specific volume that is equal to its volume (the dimension $X_i$ times dimension $Y_i$ times dimension $Z_i$) divided by the mass of the box (i.e., the mass of the material forming the box.) The collapsed box also has an initial footprint equal to its surface area defined by dimensions $X_i$ and $Y_i$.

Figure 4:
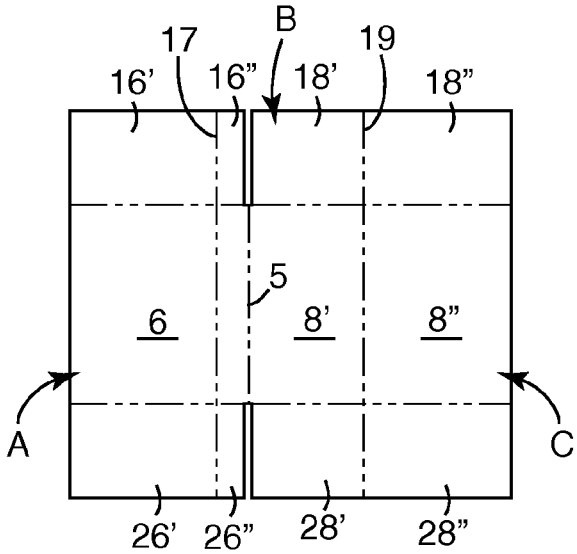
FIG. 4 is a top plan view of the collapsed box of FIG. 3 showing in phanthom creases that can be used to fold the box.

FIG. 4 shows a top plan view of the collapsed box of FIG. 3 illustrating in phantom two folding creases 17 and 19, which are offset from the original crease 5. In other embodiments, at least one of the folding creases can be aligned with the original crease. This latter case is more common in a square box. The folding creases generate three substantially equal panels, A, B, and C. The panel A includes a majority of original sidewall 6 along with a portion of the top and bottom flaps 16' and 26'. The panel B includes a portion of original sidewall 6 and a portion of original sidewall 8 (now labeled as 8') along with a portion of the top and bottom flaps, 16", 18' and 26", 28'. And, the panel C includes the balance of original sidewall 8 (now labeled as 8"), along with a portion of the top and bottom flaps 18' and 28'.

Figure 5:
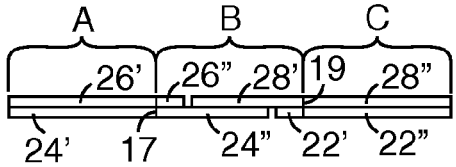
FIG. 5 is an end view of the bottom flaps of the collapsed box of FIG. 3 showing the various panels.

FIG. 5 shows an end view of the collapsed box of FIG. 4 where the bottom flaps of the panels A, B, and C are shown.

Figure 6:
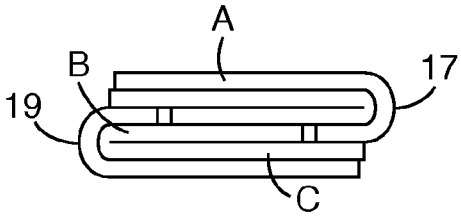
FIG. 6 is an end view of the bottom flaps of the collapsed box of FIG. 3 folded in an accordion-type manner.

FIG. 6 shows an end view of the bottom flaps of the collapsed box of FIG. 4 folded in an accordion-type manner such that panel B is sandwiched between panels A and C. The panels are disposed on top of one another such that substantially no open gap is present. The box is not folded so as to create in-folds. The creases 17 and 19 that are used to create the panels are exposed and are not contained inside the folded box.

Figure 7:
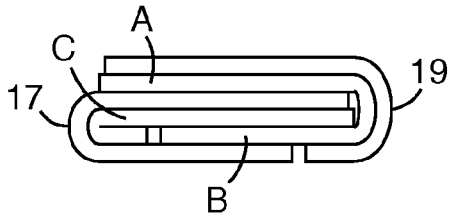
FIG. 7 is an end view of the bottom flaps of the collapsed box of FIG. 3 folded in a spiral-like manner.

FIG. 7 shows an end view of the bottom flaps of the collapsed box of FIG. 4 folded in a spiral-type manner such that panel C is sandwiched between panels A and B. The folding creases 17 and 19 are exposed. The panels are disposed on top of one another such that substantially no open gap is present. Like the embodiment in FIG. 6, the folded box does not include an in-fold.

The gaps between the bottom flaps of the box in FIGS. 6 and 7 are not open gaps as they are inherent in the construction of the box flaps. The folded boxes of FIGS. 6 and 7 show three panels, although a minimum of two panels is within the scope of the present invention. The number of panels generated is one more than the number of folding creases used. With the present invention, the user has immense flexibility in creating a folded box that is suitable for the intended purpose, whether the purpose is storing in home use or displaying on a retail shelf.

Figure 8:
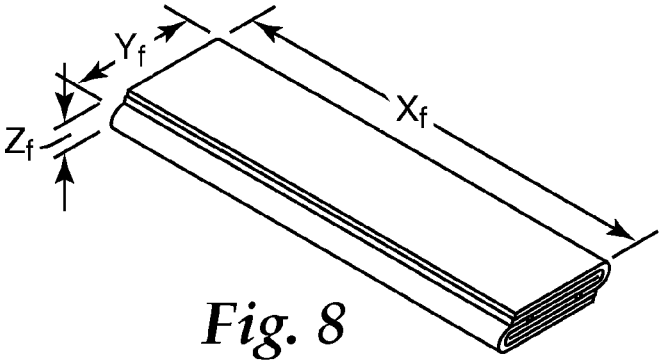
FIG. 8 is a perspective view of a folded box of FIG. 5.

FIG. 8 shows a perspective view of the folded box of FIG. 5. The folded box has a final specific volume, which is equal to the dimension $X_f$ times dimension $Y_f$ times dimension $Z_f$ divided by the mass of the box. Because the mass of the box of has not changed from its collapsed state to it's folded stated, and because the folded box contains substantially no open gap, the final specific volume of the box is substantially equal to the initial specific volume of the collapsed box. The folded box has a final footprint defined by dimensions $X_f$ and $Y_f$ which, as compared to FIG. 3, is smaller than its initial footprint. If desired, the folded box could further include a means for bundling the box, so as to keep all of the panels together. For example, straps can be used to consolidate or bundle a plurality of folded boxes together.

The folded boxes of the present invention are particularly suitable for display on a shelf in a retail store. In one aspect, the present invention pertains to a method of displaying folded box on the shelf. The method comprises the steps of: (1) providing a shelf having a defined volume determined by a surface area and a height of the shelf, (2) providing a plurality of collapsed boxes, each having an initial specific volume and an initial footprint; (3) folding each collapsed box forming at least two panels, each folded collapsed box having a final specific volume and a final footprint, wherein the panels are substantially similar in size and are disposed on top of one another, and wherein the final specific volume of the folded collapsed box is substantially similar to the initial specific volume of the collapsed box and the final footprint is smaller than the initial footprint; and (4) displaying the plurality of folded collapsed boxes on the shelf.

In another aspect, the a method of displaying a folded box on a shelf comprising the steps of: (1) providing a shelf having a defined volume determined by a surface area and a height of the shelf; (2) providing a plurality of collapsed boxes, each having an initial specific volume and an initial footprint; (3) folding the collapsed box so forming at least two panels, the folded collapsed box having a final footprint, wherein the panels are substantially similar in size and are disposed on top of one another; and wherein the folded collapsed box contains no open gaps; and (4) displaying the plurality of folded collapsed boxes on the shelf.

In both of the above-described steps, the method can further include a step of bundling the folded collapsed boxes together. The boxes can, but does not have to be of the same size, and if they are of different sizes, they most likely will have different footprints. The different size boxes can be bundled together to form even more efficient display of the boxes. The folded boxes can be displayed in any convenient manner at a retailer's selection.

The folded boxes are also particularly suited for shipping. In one aspect, the invention pertains to a method of shipping folded collapsed boxes. The method comprises the steps of: (1) providing a plurality of collapsed boxes each having an initial specific volume and an initial footprint; (2) folding the collapsed box forming at least two panels, the folded collapsed box having a final specific volume and a final footprint, wherein the panels are substantially similar in size and are disposed on top of one another and the final specific volume of the folded collapsed box is substantially similar to the initial specific volume of the collapsed box and the final footprint is smaller than the initial footprint; (3) bundling the folded collapsed boxes together; and (4) loading the bundled folded boxes into a transporter, such as a truck or rail cars.

In yet another aspect, the present invention pertains to a method for shipping a plurality of folded collapsed boxes comprising the steps of: (1) providing a plurality of collapsed boxes each having an initial first footprint; (2) folding the collapsed box forming at least two panels, the folded collapsed box having a final footprint, wherein the panels are substantially similar in size and are disposed on top of one another and the folded collapsed box contains no open gaps; (3) bundling the folded collapsed boxes together; and (4) loading the bundled folded boxes into a transporter.

What is claimed is:

1. A method of folding a box comprising the steps of:

providing a collapsed box having an initial specific volume and an initial footprint;

folding the collapsed box forming at least two panels, the folded collapsed box having a final specific volume and a final footprint, wherein the panels are substantially similar in size and are disposed on top of one another, and wherein the final specific volume of the folded collapsed box is substantially similar to the initial specific volume of the collapsed box and the final footprint is smaller than the initial footprint and wherein the folded collapsed box has no in-folds.

2. The method of claim 1, further comprising bundling the folded collapsed box.

3. The method of claim 2, wherein the bundling step comprises providing a strap and wrapping the strap around the folded collapsed box.

* * * * *

UNITED STATES PATENT AND TRADEMARK OFFICE

CERTIFICATE OF CORRECTION

PATENT NO. : 7,896,793 B2
APPLICATION NO. : 11/556239
DATED : March 1, 2011
INVENTOR(S) : Scott D. Pearson It is certified that error appears in the above-identified patent and that said Letters Patent is hereby corrected as shown below:

Column 3

Line 47, delete "shelf," and insert -- shelf; --, therefor.

Signed and Sealed this
Twelfth Day of February, 2013

Teresa Stanek Rea

Teresa Stanek Rea
*Acting Director of the United States Patent and Trademark Office*